US010073390B2

(12) United States Patent
Yamakawa

(10) Patent No.: US 10,073,390 B2
(45) Date of Patent: Sep. 11, 2018

(54) FIXING DEVICE AND IMAGE FORMING APPARATUS INCLUDING THE SAME

(71) Applicant: KYOCERA Document Solutions Inc., Osaka (JP)

(72) Inventor: Tomohiko Yamakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/660,050

(22) Filed: Jul. 26, 2017

(65) Prior Publication Data

US 2018/0046119 A1 Feb. 15, 2018

(30) Foreign Application Priority Data

Aug. 10, 2016 (JP) ..... 2016-157281

(51) Int. Cl.
*G03G 15/20* (2006.01)

(52) U.S. Cl.
CPC ..... *G03G 15/2053* (2013.01); *G03G 15/2089* (2013.01); *G03G 15/2017* (2013.01)

(58) Field of Classification Search
CPC ..... G03G 15/2053; G03G 15/2017; G03G 15/2089
See application file for complete search history.

(56) References Cited

U.S. PATENT DOCUMENTS 5,870,248 A * 2/1999 Akutsu ..... G11B 19/2009 360/99.04
2002/0136562 A1* 9/2002 Hiroki ..... G03G 15/2064 399/69
2006/0067727 A1* 3/2006 Suda ..... G03G 15/0225 399/100
2009/0267276 A1* 10/2009 Sugimoto ..... F16F 7/104 267/75
2011/0318076 A1* 12/2011 Tanda ..... G03G 15/2007 399/329

FOREIGN PATENT DOCUMENTS

JP 6-10619 U 2/1994

* cited by examiner

*Primary Examiner* — Ryan Walsh
(74) *Attorney, Agent, or Firm* — Stein IP, LLC

(57) ABSTRACT

A fixing device includes a pair of bushes, a pair of bearing members, a support plate, and a fixing frame. The pair of bushes are attached to both end parts of a rotation shaft of a heating rotating member. The pair of bearing members supports the bushes in a rotatable manner. The support plate has insertion hole into which the bearing member is inserted so that the bearing member is fastened, and a positioning pin. The fixing frame has a positioning hole into which the positioning pin is inserted. The support plate is provided with a distortion prevention part for preventing occurrence of distortion around the insertion hole when the positioning pin is inserted into the positioning hole. At least a part of the distortion prevention part is positioned within a first area.

7 Claims, 6 Drawing Sheets

FIXING DEVICE AND IMAGE FORMING APPARATUS INCLUDING THE SAME

INCORPORATION BY REFERENCE

This application is based upon and claims the benefit of priority from the corresponding Japanese Patent Application No. 2016-157281 filed Aug. 10, 2016, the entire contents of which are hereby incorporated by reference.

BACKGROUND

The present disclosure relates to a fixing device and an image forming apparatus including the fixing device. In particular, the present disclosure relates to a fixing device including a bearing member for supporting a rotation shaft of a heating rotating member, a support plate for supporting the bearing member, and a fixing frame for supporting the support plate, and to an image forming apparatus including the fixing device.

Conventionally, in an electrophotographic image forming apparatus such as a copier or a printer, a toner image is carried on a surface of an image carrier such as a photosensitive drum or an intermediate transfer belt, the toner image carried on the surface of the image carrier is transferred to a recording medium, the recording medium is conveyed to a fixing device, the toner image is fixed to the recording medium by the fixing device, and the recording medium is conveyed to a discharge tray or the like.

The fixing device is constituted of, for example, a fixing member including a heating roller (heating rotating member) and a pressure roller (pressing rotating member), bushes attached to both ends of a rotation shaft of the heating roller, a bearing member supporting the bush in a rotatable manner, a support plate having an insertion hole to which the bearing member is inserted so as to fasten the bearing member, and a fixing frame for supporting the support plate.

In this fixing device, the support plate is provided with a positioning pin extending in an axial direction of the rotation shaft of the heating roller, and the fixing frame is provided with a positioning hole to which the positioning pin is inserted. Then, the positioning pin is inserted into the positioning hole, and hence the support plate is positioned to the fixing frame.

SUMMARY

A fixing device according to a first aspect of the present disclosure includes a fixing member, a pair of bushes, a pair of bearing members, a support plate, and a fixing frame. The fixing member includes a heating rotating member and a pressing rotating member pressed to the heating rotating member, so as to heat and press the recording medium having a surface carrying a toner image so that the toner image is fixed to the recording medium. The pair of bushes are attached to both end parts of a rotation shaft of the heating rotating member. The pair of bearing members support the bushes in a rotatable manner. The support plate has an insertion hole into which the bearing member is inserted so that the bearing member is fastened, and a positioning pin extending in an axial direction of the rotation shaft. The fixing frame has a positioning hole into which the positioning pin is inserted so as to support the support plate. The support plate is provided with a distortion prevention part that prevents occurrence of distortion around the insertion hole when the positioning pin is inserted into the positioning hole. At least a part of the distortion prevention part is positioned within a first area of the support plate sandwiched between a first half line that starts from a first center of the insertion hole and passes a second center of the positioning pin, and a second half line that starts from the first center and extends in the opposite direction to a third center of the pressing rotating member.

Other objects of the present disclosure and specific advantages obtained by the present disclosure will become more apparent from the description of embodiments given below.

DETAILED DESCRIPTION

Hereinafter, an embodiment of the present disclosure is described with reference to the drawings.

Figure 1:
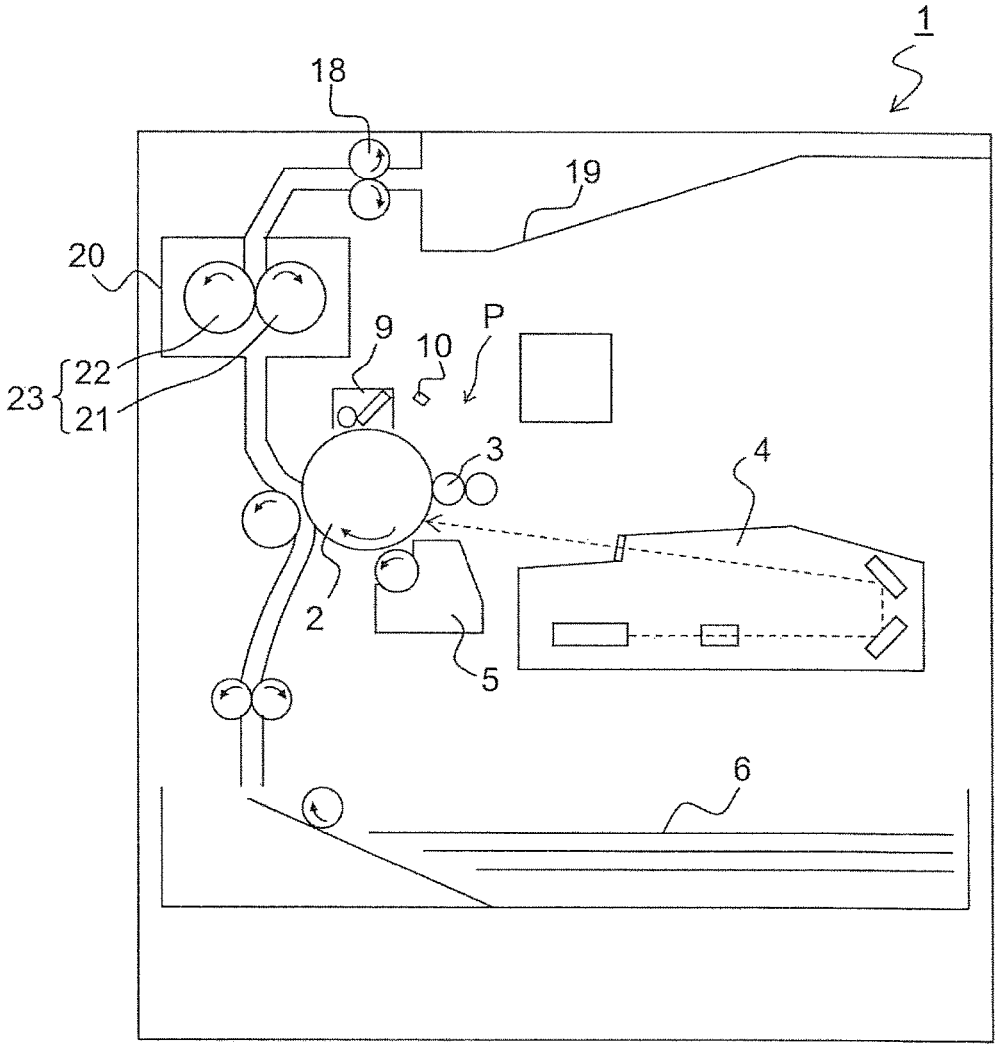
FIG. 1 is a cross-sectional view illustrating a structure of an image forming apparatus including a fixing device according to an embodiment of the present disclosure.

With reference to FIGS. 1 to 9, an image forming apparatus 1 including a fixing device 20 according to an embodiment of the present disclosure is described. Note that in FIG. 1, the right side corresponds to the front side of the image forming apparatus 1. As illustrated in FIG. 1, an image forming unit P is disposed in the image forming apparatus 1 (here, a monochromatic printer). This image forming unit P forms a predetermined image by steps of electrification, exposure, developing, and transferring.

The image forming unit P is provided with a photosensitive drum (image carrier) 2 that carries a visible image (toner image). The toner image formed on the photosensitive drum 2 is transferred to a paper sheet (recording medium) 6, and is further fixed to the paper sheet 6 by the fixing device 20. Then, the paper sheet 6 is discharged from an apparatus main body. A drum drive motor (not shown) drives the photosensitive drum 2 to rotate in a clockwise direction in FIG. 1 while the image forming process is performed on the photosensitive drum 2.

In addition, around and in the front side (the right side in FIG. 1) of the photosensitive drum 2 disposed in a rotatable manner, there are disposed a charging roller 3 for charging the photosensitive drum 2, an exposing unit 4 for exposing the photosensitive drum 2 with image information, a developing unit 5 for forming a toner image on the photosensitive drum 2, a cleaning device 9 for collecting developer (toner) remaining on the photosensitive drum 2, and a charge eliminator 10 for eliminating an electrostatic latent image.

The paper sheet 6 with the toner image transferred from the photosensitive drum 2 is conveyed to the fixing device 20. The paper sheet 6 conveyed to the fixing device 20 is heated and pressed by a fixing roller 21 and a pressure roller 22 described later so that the toner image is fixed to the surface of the paper sheet 6, and thus a predetermined image is formed. The paper sheet 6 with the formed image is then discharged to a discharge tray 19 by a discharge roller pair 18.

Figure 2:
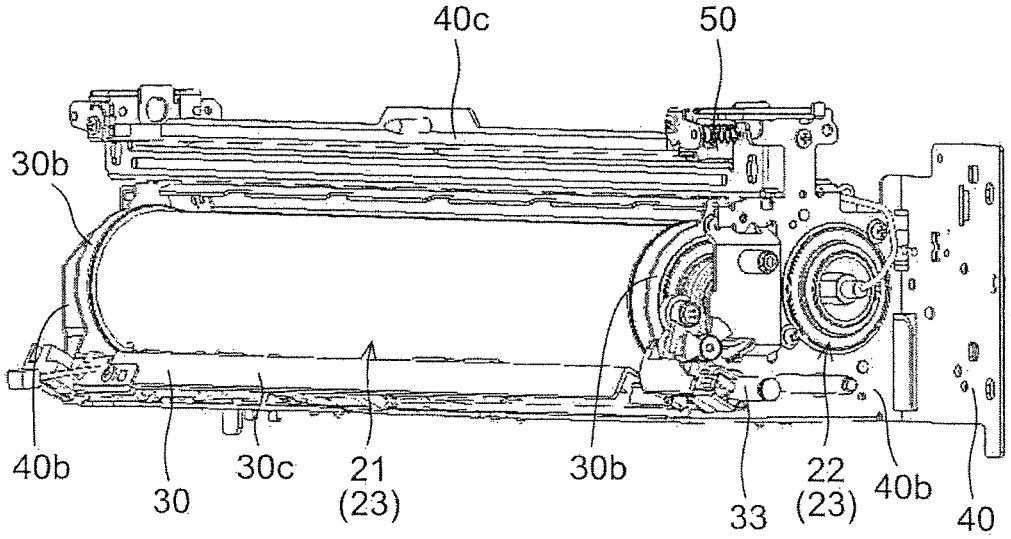
FIG. 2 is a perspective view illustrating a structure of a fixing roller, a fixing frame, and their periphery of the fixing device according to an embodiment of the present disclosure.

As illustrated in FIG. 2, the fixing device 20 includes a fixing member 23 constituted of the fixing roller (heating rotating member) 21 and the pressure roller (pressing rotating member) 22, a support plate 30 made of sheet metal for supporting the fixing roller 21, and a fixing frame 40 made of sheet metal for supporting the support plate 30. Note that FIG. 2 illustrates a state viewed from the rear side of FIG. 1, and positional relationship of the members in FIG. 2 is opposite to that in FIG. 1 in the right and left direction.

The fixing roller 21 heats unfixed toner carried on the paper sheet 6. The fixing roller 21 is a so-called hard roller constituted of a cylindrical metal core made of metal such as aluminum or iron that is superior in thermal conductivity, and fluorine resin coating or tube covering the metal core. In addition, a halogen heater (not shown) as a heat source is disposed inside the core metal of the fixing roller 21, and the surface of the fixing roller 21 is kept at a predetermined temperature. In addition, the fixing roller 21 is linked to a drive motor via a gear train (both not shown) and is driven to rotate by a driving force from the drive motor.

The pressure roller 22 rotates while being pressed to contact with the fixing roller 21 at a predetermined pressure. The pressure roller 22 is constituted of a cylindrical base material made of synthetic resin, metal or other material, and an elastic layer of silicone rubber or the like formed on the base material, and the surface of the elastic layer is coated with resin such as fluorine resin having good release characteristics.

The fixing roller 21 is supported by the support plate 30 in a rotatable manner, and the pressure roller 22 is supported by the fixing frame 40 in a rotatable manner. A lower part of the support plate 30 is pivoted to the fixing frame 40 in a rockable manner, and the fixing roller 21 can contact with and separate from the pressure roller 22. An upper part of the support plate 30 is biased toward the pressure roller 22 by a pair of biasing members 50 constituted of a compression coil spring.

Hereinafter, a detailed structure of the fixing device 20 is described.

Figure 3:
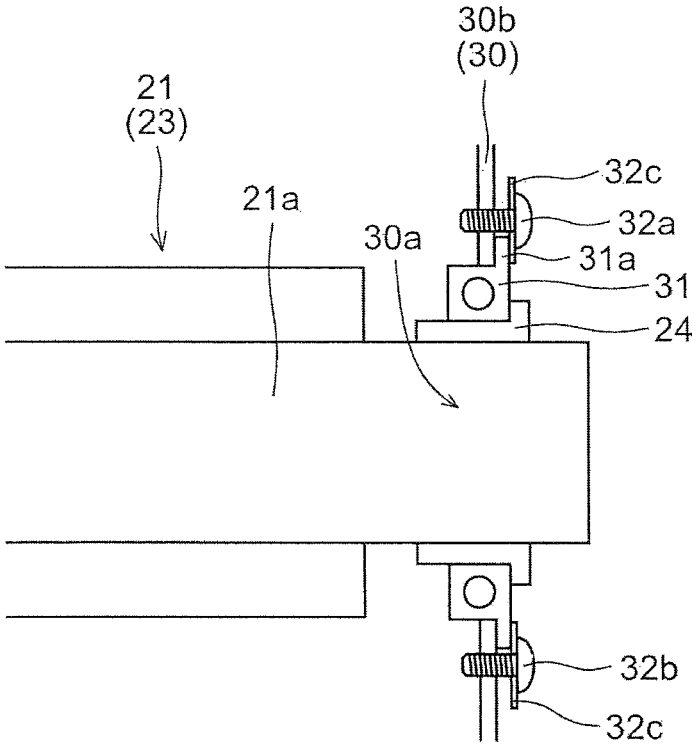
FIG. 3 is a cross-sectional view illustrating a structure of an end part of the fixing roller and its periphery of the fixing device according to an embodiment of the present disclosure.

As illustrated in FIG. 3, a pair of bushes 24 made of heat-resistant resin are attached to both end parts of a rotation shaft 21*a* of the fixing roller 21. In addition, the both end parts of the rotation shaft 21*a* are supported by bearings (bearing members) 31 via the bushes 24 in a rotatable manner.

The bearing 31 is inserted in an insertion hole 30*a* formed in the support plate 30 and is fastened to the support plate 30 with two screws 32*a* and 32*b*.

Figure 4:
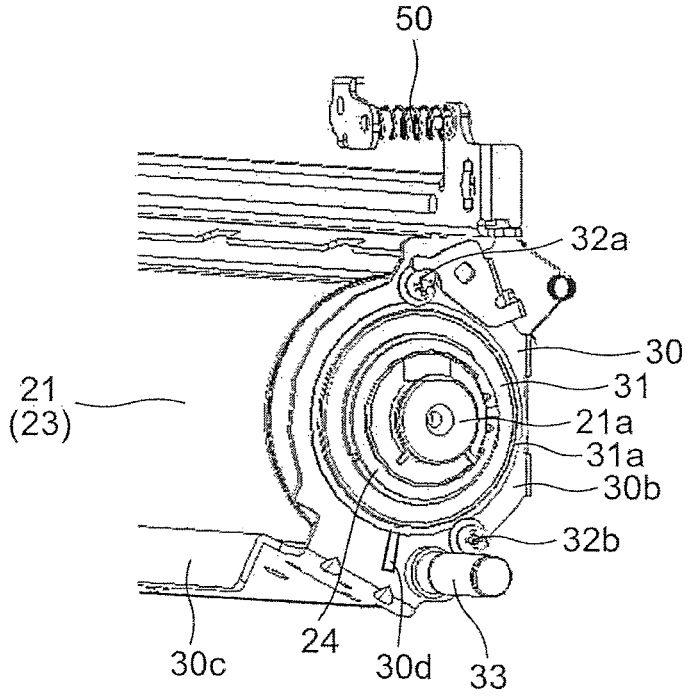
FIG. 4 is a perspective view illustrating a structure of the end part of the fixing roller and its periphery of the fixing device according to an embodiment of the present disclosure.
Figure 5:
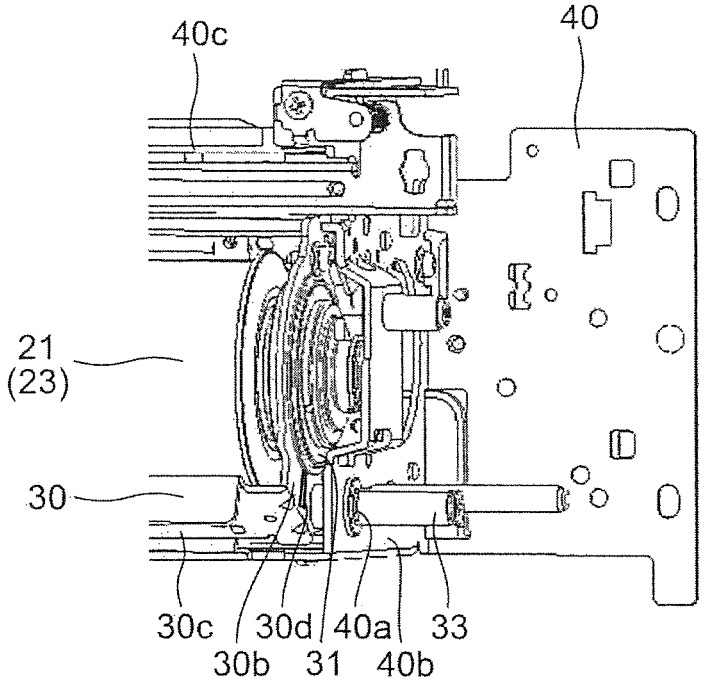
FIG. 5 is a perspective view illustrating a structure of the end part of the fixing roller and its periphery of the fixing device according to an embodiment of the present disclosure.

As illustrated in FIGS. 2 and 4, the support plate 30 is constituted of a pair of side surface parts 30*b* each provided with the insertion hole 30*a* (see FIG. 3) and a connecting part 30*c* that connects the pair of side surface parts 30*b*. The side surface part 30*b* is disposed substantially perpendicular to an axial direction of the rotation shaft 21*a* of the fixing roller 21. A positioning pin 33 extending in the axial direction of the rotation shaft 21*a* is fastened to the lower part of the side surface part 30*b* by means of caulking or the like. The screws 32*a* and 32*b* press a flange part 31*a* of the bearing 31 to the side surface part 30*b* via a washer 32*c* (see FIG. 3).

The fixing frame 40 is constituted of a pair of frame side surface parts 40*b* provided with a positioning hole 40*a* (see FIG. 5) into which the positioning pin 33 is inserted, and a frame connecting part 40*c* that connects the pair of frame side surface parts 40*b*. The frame side surface parts 40*b* are disposed substantially perpendicular to the axial direction of the rotation shaft 21*a* of the fixing roller 21. In the state where the positioning pin 33 is inserted into the positioning hole 40*a*, the support plate 30 can rock about the positioning pin 33.

Figure 6:
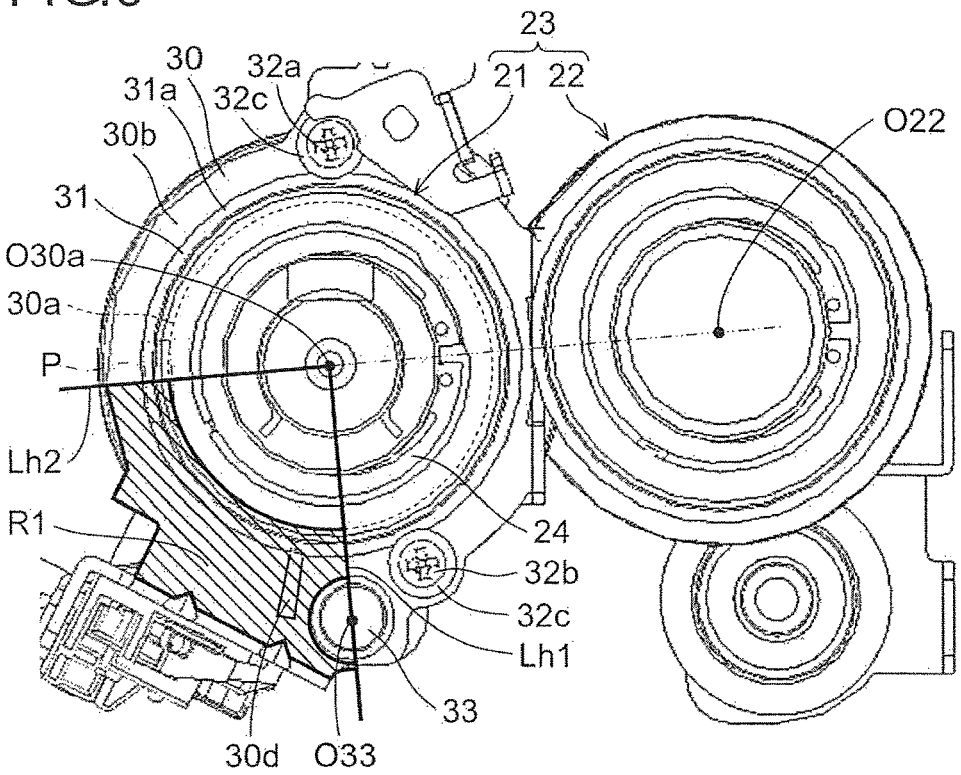
FIG. 6 is a side view illustrating a structure of a support plate and its periphery of the fixing device according to an embodiment of the present disclosure.
Figure 7:
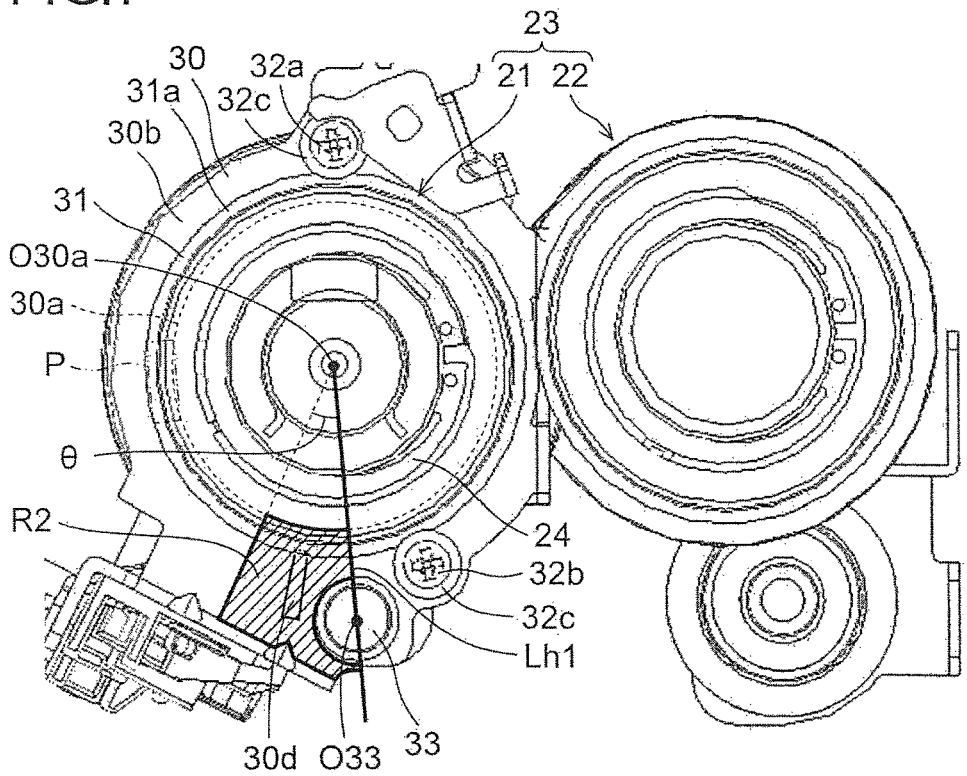
FIG. 7 is a side view illustrating a structure of the support plate and its periphery of the fixing device according to an embodiment of the present disclosure.
Figure 8:
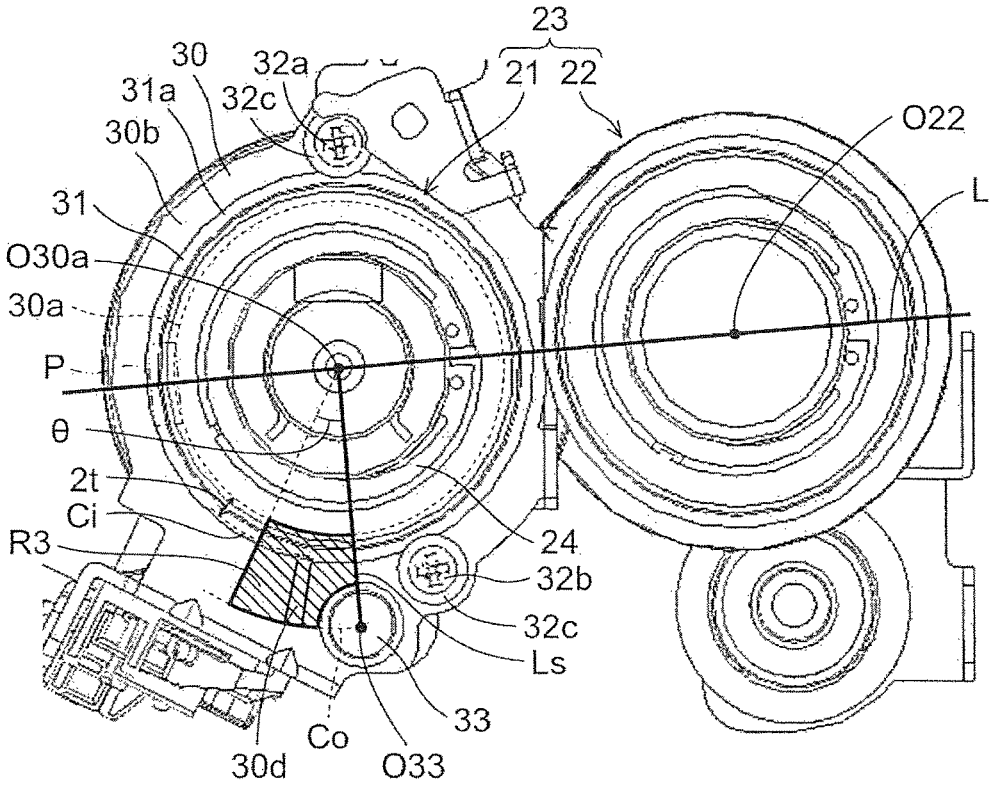
FIG. 8 is a side view illustrating a structure of the support plate and its periphery of the fixing device according to an embodiment of the present disclosure.

As illustrated in FIGS. 6 to 8, the side surface part 30*b* of the support plate 30 has a first area R1, a second area R2, and a third area R3. The first area R1 is an area sandwiched between a first half line Lh1 that starts from a first center O30*a* of the insertion hole 30*a* and passes a second center O33 of the positioning pin 33, and a second half line Lh2 that starts from the first center O30*a* and extends in the opposite direction to a third center O22 of the pressure roller 22.

The second area R2 is an area over which the first half line Lh1 passes when it is rotated about the first center O30*a* in a direction separating from the pressure roller 22 (in the clockwise direction in FIG. 7) by 30 degrees (=θ). The third area R3 is an area over which a line segment Ls connecting the first center O30*a* and the second center O33 passes when it is rotated about the first center O30*a* in the direction separating from the pressure roller 22 by 30 degrees (=θ). Therefore, the first area R1 includes the second area R2, and the second area R2 includes the third area R3. The first half line Lh1 is substantially perpendicular to a straight line L passing the first center O30*a* and the third center O22 of the pressure roller 22. In other words, the positioning pin 33 is disposed at a position away from the first center O30*a* in a direction substantially perpendicular to the straight line L.

Note that, when the fixing roller 21 and the pressure roller 22 are pressed to contact with each other, in an edge part of the insertion hole 30*a* in the side surface part 30*b*, a force from the pressure roller 22 is applied most at a part most away from the pressure roller 22 (maximum load part P).

In addition, a distortion prevention hole (distortion prevention part) 30*d* is formed in the side surface part 30*b* of the support plate 30 so that at least a part thereof is positioned within the first area R1. It is preferred that the entire distortion prevention hole 30*d* be positioned within the second area R2, and that at least a part thereof be positioned within the third area R3. Note that in this embodiment, the entire distortion prevention hole 30*d* is positioned within the third area R3.

Figure 9:
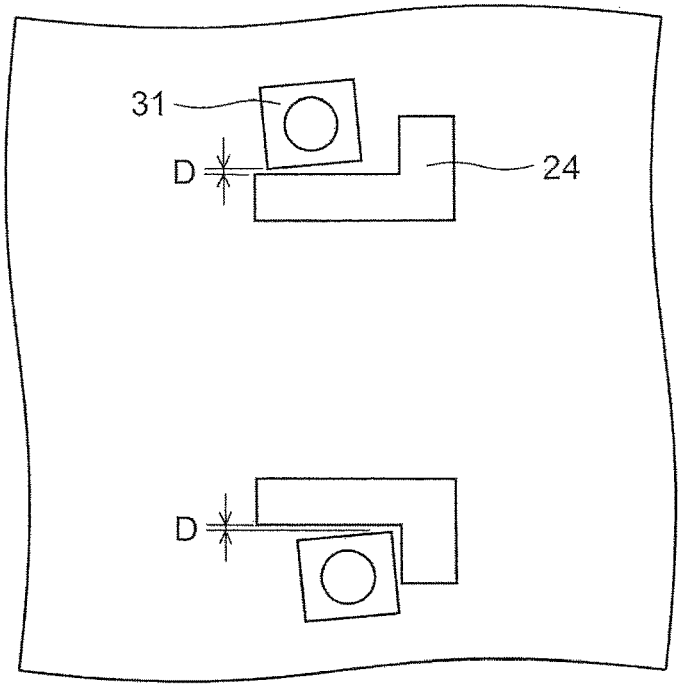
FIG. 9 is a diagram illustrating a state of a bearing and a bush in a state where the bearing is out of perpendicular to a rotation shaft of the fixing roller.

Even if the positioning pin 33 is not completely perpendicular to the side surface part 30*b*, the distortion prevention hole 30*d* prevents occurrence of distortion around the insertion hole 30*a* when the positioning pin 33 is inserted into the positioning hole 40*a*. Note that if the distortion prevention hole 30*d* is not provided and the positioning pin 33 is not completely perpendicular to the side surface part 30*b*, a distortion occurs in the entire side surface part 30*b* when the positioning pin 33 is inserted into the positioning hole 40*a*, and hence the bearing 31 fastened to the side surface part 30*b* is not perpendicular to the rotation shaft 21*a* of the fixing roller 21. As a result, as illustrated in FIG. 9, the inner circumferential surface of the bearing 31 and the outer circumferential surface of the bush 24 do not become parallel to each other, and a clearance D between the bearing 31 and the bush 24 becomes small.

In addition, when a thickness of the support plate 30 is represented by t, the distortion prevention hole 30*d* is disposed away from the opening edge of the insertion hole 30*a* by 2*t* or more as illustrated in FIG. 8. In this embodiment, an arc away from the insertion hole 30*a* by 2*t* is represented by Ci, and an arc over which the second center O33 passes when it is rotated about the first center O30*a* in the direction separating from the pressure roller 22 is represented by Co. Then, the distortion prevention hole 30*d* is formed from the arc Ci to the arc Co. Note that the screws 32*a* and 32*b* are positioned on the opposite side to the distortion prevention hole 30*d* with respect to the first half line Lh1.

In this embodiment, as described above, the support plate 30 is provided with the distortion prevention hole 30*d* that prevents occurrence of distortion around the insertion hole 30*a* when the positioning pin 33 is inserted into the positioning hole 40*a*. In this way, when the positioning pin 33 is not completely perpendicular to the support plate 30, even if the positioning pin 33 follows to (corrected by) the fixing frame 40 when the positioning pin 33 is inserted into the positioning hole 40*a*, the distortion prevention hole 30*d* can prevent occurrence of distortion around the insertion hole 30*a*. Therefore, it is possible to prevent inclination of the bearing 31 inserted into the insertion hole 30*a*, and hence the clearance D between the bearing 31 and the bush 24 can be prevented from being small. As a result, it is possible to prevent generation of unusual sound when the bush 24 moves relatively to the bearing 31 in the axial direction.

In addition, at least a part of the distortion prevention hole 30*d* is positioned within the first area R1. In this way, the distortion prevention hole 30*d* can be positioned between the positioning pin 33 and the maximum load part P at which a force from the pressure roller 22 is applied most in the support plate 30 when the fixing roller 21 is pressed to contact with the pressure roller 22, and hence it is possible to prevent occurrence of distortion around the maximum load part P. Therefore, it is possible to effectively prevent generation of unusual sound.

In addition, as described above, the entire distortion prevention hole 30*d* is positioned within the second area R2. In this way, it is possible to prevent the distortion prevention hole 30*d* from being positioned near the maximum load part P, and hence it is possible to prevent a distortion from being generated in the support plate 30 by a force from the pressure roller 22 when the fixing roller 21 and the pressure roller 22 are pressed to contact with each other.

In addition, at least a part of the distortion prevention hole 30*d* is positioned within the third area R3. In this way, the distortion prevention hole 30*d* can be easily positioned between the maximum load part P and the positioning pin 33, and hence it is possible to easily prevent a distortion from being generated near the maximum load part P.

In addition, as described above, the entire distortion prevention hole 30*d* is positioned within the third area R3. In this way, the distortion prevention hole 30*d* can be prevented from being too large, and hence it is possible to prevent a decrease in strength of the support plate 30.

In addition, as described above, the distortion prevention hole 30*d* is positioned away from the opening edge of the insertion hole 30*a* by twice the thickness of the support plate 30 or more (2t or more). In this way, a boring process for forming the distortion prevention hole 30*d* can be easily performed.

In addition, as described above, the screws 32*a* and 32*b* are positioned on the opposite side to the distortion prevention hole 30*d* with respect to the first half line Lh1. In this way, the position at which the distortion prevention hole 30*d* is formed is not limited by the screws 32*a* and 32*b*.

In addition, as described above, the first half line Lh1 is substantially perpendicular to the straight line L passing the first center O30*a* and the third center O22. In this way, the distortion prevention hole 30*d* can be positioned away from the maximum load part P, and hence it is possible to easily prevent a distortion from being generated in the support plate 30 by a force from the pressure roller 22 when the fixing roller 21 and the pressure roller 22 are pressed to contact with each other.

Note that the embodiment disclosed above is merely an example in every aspect and should not be interpreted as a limitation. The scope of the present disclosure is defined by not the description of the above embodiment but by the claims, and should be understood to include all modifications within meanings and scopes equivalent to the claims.

For example, the above description exemplifies a case where the present disclosure is applied to the monochromatic printer, but the present disclosure is not limited to this. It is needless to say that the present disclosure can be applied to other image forming apparatuses such as a color printer, a monochromatic copier, a color copier, a digital multifunction peripheral, and a facsimile machine.

Figure 10:
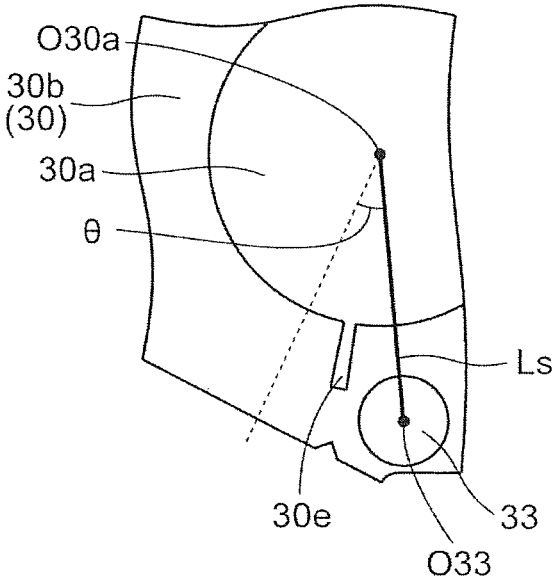
FIG. 10 is a diagram illustrating a structure of the support plate of the fixing device according to a variation of the present disclosure.

In addition, the above embodiment exemplifies a case where the support plate 30 is provided with the distortion prevention hole 30*d* as the distortion prevention part, but the present disclosure is not limited to this. For example, as illustrated in FIG. 10 as a variation of the present disclosure, a distortion prevention notch (distortion prevention part) 30*e* may be provided by cutting the edge part of the insertion hole 30*a*.

What is claimed is:

1. A fixing device comprising:

a fixing member including a heating rotating member and a pressing rotating member pressed to contact with the heating rotating member, the fixing member heating and pressing a recording medium with a toner image carried on the surface thereof so as to fix the toner image to the recording medium;

a pair of bushes attached to both end parts of a rotation shaft of the heating rotating member;

a pair of bearing members for supporting the bushes in a rotatable manner;

a support plate provided with an insertion hole into which the bearing member is inserted so that the bearing member is fastened, and a positioning pin extending in an axial direction of the rotation shaft; and a fixing frame provided with a positioning hole into which the positioning pin is inserted, so as to support the support plate, wherein the support plate is provided with a distortion prevention part for preventing occurrence of distortion around the insertion hole when the positioning pin is inserted into the positioning hole, and at least a part of the distortion prevention part is positioned within a first area of the support plate sandwiched between a first half line starting from a first center of the insertion hole and passing a second center of the positioning pin, and a second half line starting from the first center and extending in an opposite direction to a third center of the pressing rotating member.

2. The fixing device according to claim 1, wherein the support plate has a second area over which the first half line passes when the first half line is rotated about the first center in a direction separating from the pressing rotating member by 30 degrees, and a third area over which a line segment connecting the first center and the second center passes when the line segment is rotated about the first center in the direction separating from the pressing rotating member by 30 degrees, and the entire distortion prevention part is positioned within the second area, and at least a part of the distortion prevention part is positioned within the third area.

3. The fixing device according to claim 2, wherein the entire distortion prevention part is positioned within the third area.

4. The fixing device according to claim 1, wherein the distortion prevention part is positioned away from an opening edge of the insertion hole by twice the thickness of the support plate or more.

5. The fixing device according to claim 1, further comprising a screw for fastening bearing member to the support plate, wherein the screw is positioned on the opposite side to the distortion prevention part with respect to the first half line.

6. The fixing device according to claim 1, wherein the first half line is substantially perpendicular to a straight line passing the first center and the third center.

7. An image forming apparatus comprising the fixing device according to claim 1.

* * * * *